US009821591B1

(12) United States Patent
Kato

(10) Patent No.: US 9,821,591 B1
(45) Date of Patent: Nov. 21, 2017

(54) IMAGE FORMING APPARATUS AND MASK FORMING METHOD

(71) Applicants: KABUSHIKI KAISHA TOSHIBA, Tokyo (JP); TOSHIBA TEC KABUSHIKI KAISHA, Tokyo (JP)

(72) Inventor: Mitsuhisa Kato, Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/412,823

(22) Filed: Jan. 23, 2017

(51) Int. Cl.
*B41M 7/00* (2006.01)

(52) U.S. Cl.
CPC ..... *B41M 7/0009* (2013.01)

(58) Field of Classification Search
CPC ..... B41M 7/009; B41M 7/0009; B41M 7/00
See application file for complete search history.

(56) References Cited

U.S. PATENT DOCUMENTS 5,485,557 A * 1/1996 Sato ..... G06T 1/20 345/634
6,065,679 A * 5/2000 Levie ..... G06Q 20/343 235/462.47
2002/0054397 A1* 5/2002 Matsushima ..... G06F 17/30893 358/524
2016/0291905 A1* 10/2016 Subbaian ..... G06F 3/1219

FOREIGN PATENT DOCUMENTS

JP 2015-197672 11/2015

* cited by examiner

*Primary Examiner* — Kristal Feggins
(74) *Attorney, Agent, or Firm* — Patterson & Sheridan, LLP

(57) ABSTRACT

An image forming apparatus according to an embodiment includes a decolorable image forming unit that forms a decolorable image with a decolorable material. A mask control unit controls the decolorable image forming unit to form, with the decolorable material on a sheet, a mask that hides at least one portion of an image formed on the sheet with non-decolorable material.

20 Claims, 9 Drawing Sheets

(A)

CUSTOMER CARD

CUSTOMER NUMBER:123456
NAME:YYYY ZZZZ
ADDRESS
BIRTHDAY
TELEPHONE NUMBER
MAIL ADDRESS 80-4

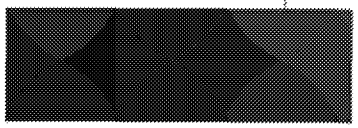

FAMILY STRUCTURE HUSBAND XXXX ZZZZ
ELDEST SON AAAA ZZZZ

HOBBY: DANCE

HOPE DIRECT MAIL

COMMODITY PURCHASE CAREER

MONTH DAY SHOULDER BAG
MONTH DAY SHOES (BROWN)
⋮

(B)

CUSTOMER CARD

CUSTOMER NUMBER:123456
NAME:YYYY ZZZZ
ADDRESS ###PREFECTURE##CITY
TOWN###
BIRTHDAY JUNE 15, 200
TELEPHONE NUMBER 1234-5678
MAIL ADDRESS ####@####.Com

FAMILY STRUCTURE HUSBAND XXXX ZZZZ
ELDEST SON AAAA ZZZZ

HOBBY: DANCE

HOPE DIRECT MAIL

COMMODITY PURCHASE CAREER

MONTH DAY SHOULDER BAG
MONTH DAY SHOES (BROWN)
⋮

FIG.5

IMAGE FORMING APPARATUS AND MASK FORMING METHOD

FIELD

Embodiments described herein relate generally to an image forming apparatus and a mask forming method.

BACKGROUND

In recent years, the importance of information security such as preventing leakage of personal information is increased. For example, personal information on a document may be leaked by a method such as "shoulder surfing" (peeking over a user's shoulder).

However, the document having the personal information typically has no means to hide information that a person may be desired to be kept secret. Thus, it is difficult to prevent personal information leakage.

DESCRIPTION OF THE DRAWINGS

FIG. 5 is a view illustrating an example of attaching a mask to a customer card (A), and an example of erasing the mask from the customer card (A);

DETAILED DESCRIPTION

An image forming apparatus according to an embodiment includes a decolorable image forming unit that forms a decolorable image with a decolorable material. A mask control unit controls the decolorable image forming unit to form, with the decolorable material on a sheet, a mask that hides at least one portion of an image formed on the sheet with non-decolorable material.

Hereinafter, an image forming apparatus and a mask forming method of an embodiment are described with reference to the accompanying drawings. Further, "decoloring" according to the present embodiment refers to a processing of making a visible image formed with a color (containing not only chromatic colors but also achromatic colors such as white, black and the like) to be invisible.

Figure 1:
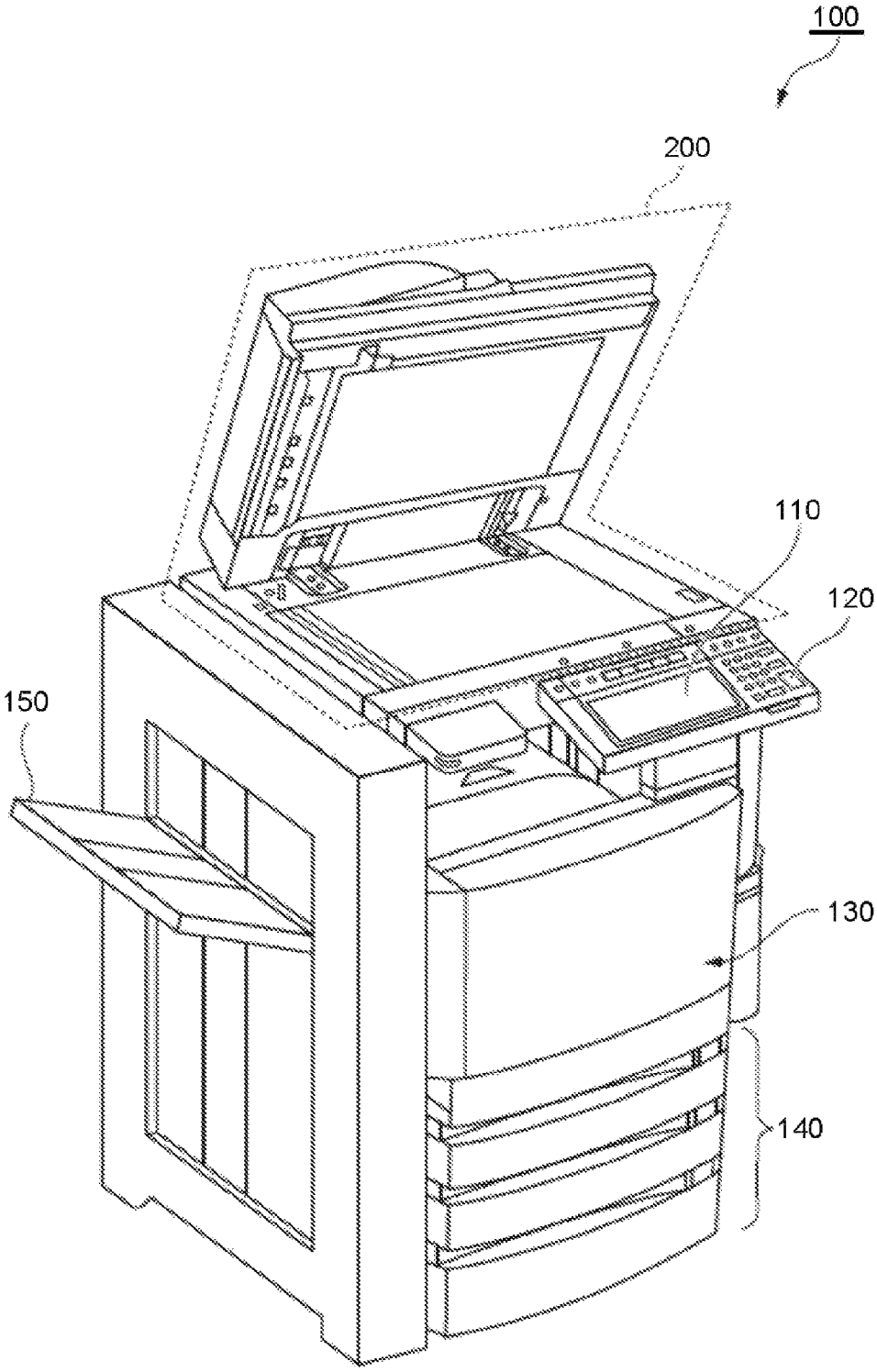
FIG. 1 is a perspective view illustrating an example configuration of an image forming apparatus according to an embodiment.

FIG. 1 is a perspective view illustrating an example configuration of an image forming apparatus 100 according to the embodiment. The image forming apparatus 100 is, for example a multi-functional peripheral. The image forming apparatus 100 includes a display 110, a control panel 120, a printer unit 130, a sheet housing unit 140 and an image reading unit 200. The printer unit 130 of the image forming apparatus 100 may be a device for fixing a toner image or an inkjet type device. The cartridge of toner and the cartridge of ink are collectively referred to simply as a cartridge. The toner includes both decolorable toner that can be decolored later and toner (hereinafter, referred to as "non-decolorable toner") that cannot be decolored.

The image forming apparatus 100 forms an image on a sheet with a recording agent such as toner. The sheet is, for example, a paper or a label paper. The sheet may be any object as long as the image forming apparatus 100 can form an image on the its surface.

The display 110 is an image display device such as a liquid crystal display, an organic EL (Electro Luminescence) display or the like. The display 110 displays various kinds of information relating to the image forming apparatus 100.

The control panel 120 includes a plurality of buttons. The control panel 120 receives an operation input by a user. The control panel 120 outputs a signal corresponding to the operation input by the user to a control unit of the image forming apparatus 100. The display 110 and the control panel 120 can be separate or both may be integrated into a single touch panel.

The printer unit 130 forms an image on a sheet on the basis of image information generated by the image reading unit 200 or image information received via a communication interface. The printer unit 130 forms an image through, for example, the following process. The image forming unit of the printer unit 130 forms an electrostatic latent image on a photoconductive drum based on the image information. The image forming unit of the printer unit 130 applies the recording agent to the electrostatic latent image to form a visible image. As an example of the recording agent, toner may be used. The transfer unit of the printer unit 130 transfers the visible image onto the sheet. The fixing unit of the printer unit 130 applies heat and pressure to the sheet to fix the visible image on the sheet.

Further, the sheet on which the image is formed may be a sheet supplied from the sheet housing unit 140 or a manually fed sheet. The sheet housing unit 140 houses the sheet used for the image formation by the printer unit 130. After the image formation is carried out, the sheet is discharged to a tray 150.

The image reading unit 200 generates the image information by reading a read object as intensity of light. The image reading unit 200 records the generated image information. The generated image information may be sent another information processing apparatus via a network. The generated image information may be used for the image formation on the sheet through the printer unit 130.

Figure 2:
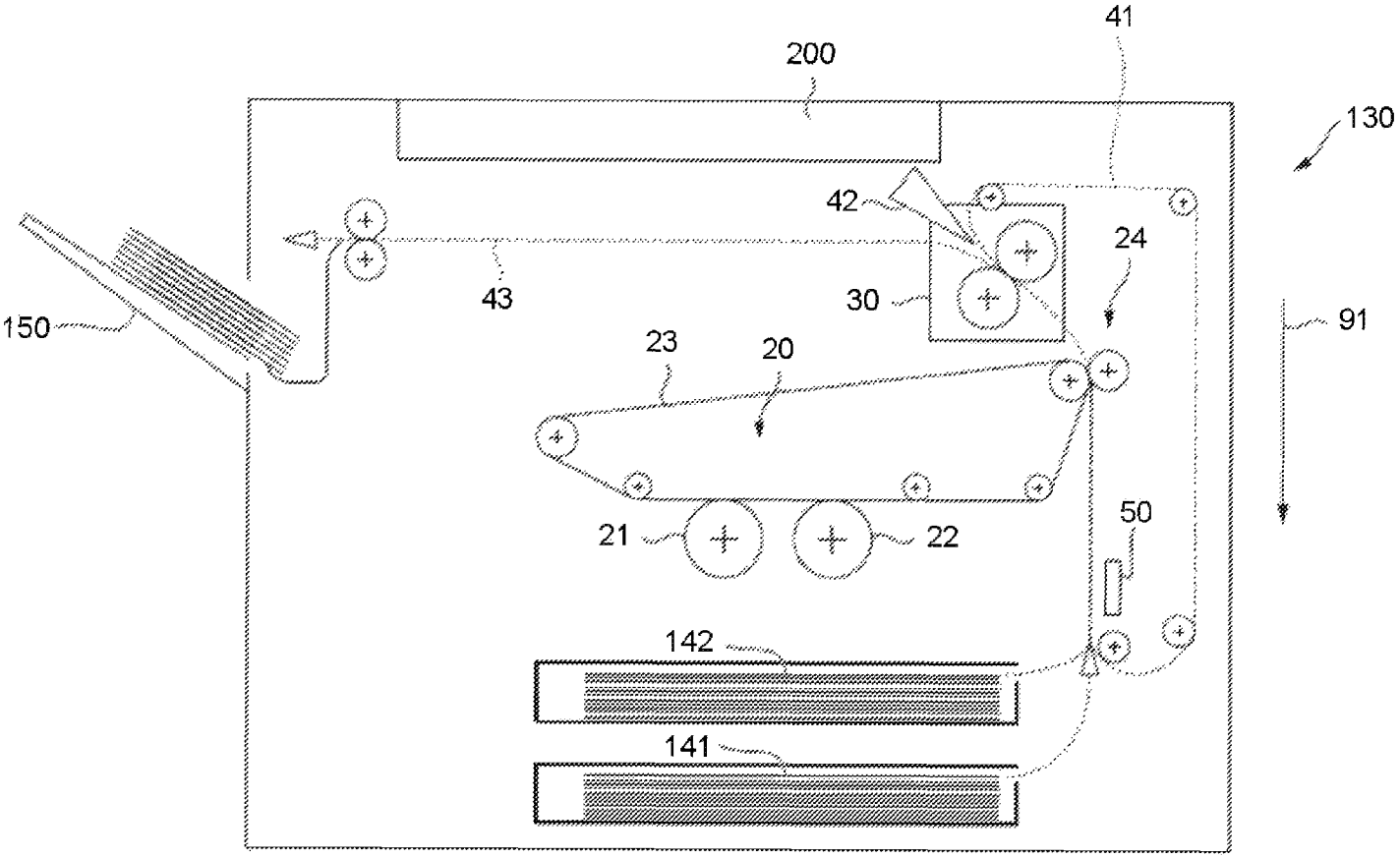
FIG. 2 is an example cross-sectional view of the image forming apparatus.

FIG. 2 is a cross-sectional view illustrating the image forming apparatus 100 shown in FIG. 1. FIG. 2 illustrates the configuration of main portion of the printer unit 130. An image forming unit 20 is includes a first image forming unit 21, a second image forming unit 22, a transfer belt 23 and a secondary transfer unit 24. In the first image forming unit 21 (non-decolorable image forming unit), the non-decolorable toner (which is fixed on the sheet at the temperature of 110 degrees centigrade) is used. In the second image forming unit 22 (decolorable image forming unit), the decolorable toner (which is fixed on the sheet at the temperature of 110 degrees centigrade and decolored at the temperature of 130 degrees centigrade) is used. The toner image formed in the first image forming unit 21 is temporarily transferred onto the transfer belt 23. Then, the toner image is transferred onto a sheet 141 or a sheet 142 which is supplied from the sheet housing unit 140 in the secondary transfer unit 24. The sheet to which the toner image is transferred is fixed in a fixing device 30 at 110 degrees centigrade.

A conveyance control device 42 controls a sheet conveyance, and the sheet passes through a conveyance path 41 towards the direction of a direction 91 and returns to the secondary transfer unit 24 again. During this time, the toner image formed in the second image forming unit 22 is transferred onto the transfer belt 23. Then, the toner image is superposed and transferred onto the sheet which passes through the conveyance path 41 and returns in the secondary transfer unit 24. The sheet to which the toner transfer is carried out is fixed in a fixing device 30 at 110 degrees centigrade. Then, the conveyance control device 42 controls the sheet conveyance, and the fixed sheet passes through the conveyance path 41. Then, the sheet on which the non-decolorable toner and the decolorable toner are fixed is discharged to the tray 150.

Figure 3:
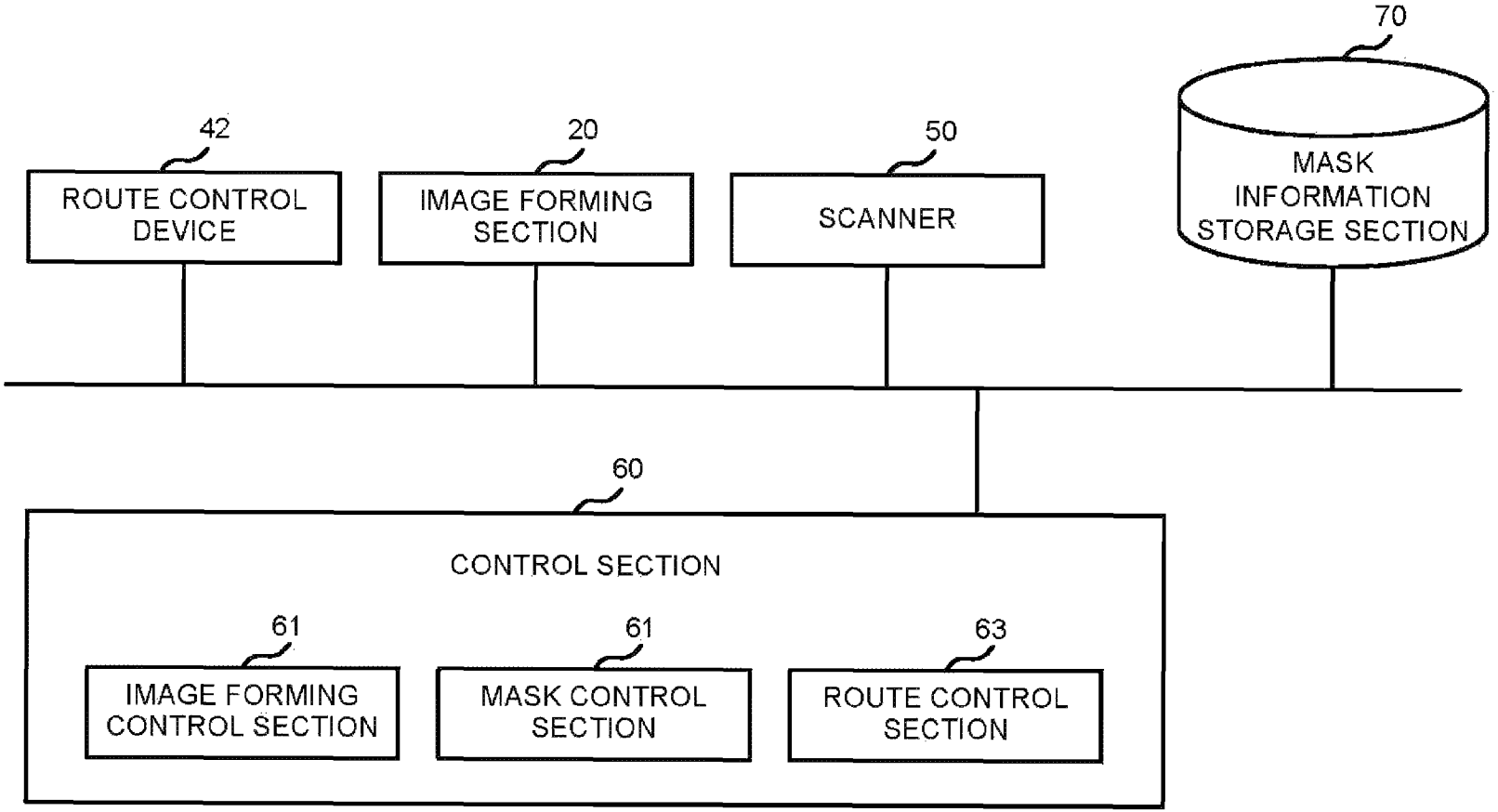
FIG. 3 is a block diagram illustrating an example configuration of a control system of a printer unit.

FIG. 3 is a block diagram illustrating an example configuration of a control system of the printer unit 130 shown in FIG. 2. A control unit 60 collectively controls the operations of the image forming unit 20, the conveyance control device 42, and the scanner 50. The scanner 50 reads the image formed on the sheet before the toner transfer in the secondary transfer unit 24. The control unit 60 is provided with an image forming control unit 61, a mask control unit 62 and a conveyance control unit 63. The image forming control unit 61 controls the operations of the image forming unit 20. The mask control unit 62 controls the operations for forming a mask on the sheet. The conveyance control unit 63 controls the operations for the conveyance control device 42. A mask information storage unit 70 stores mask information for a mask formed on the sheet.

Figure 4:
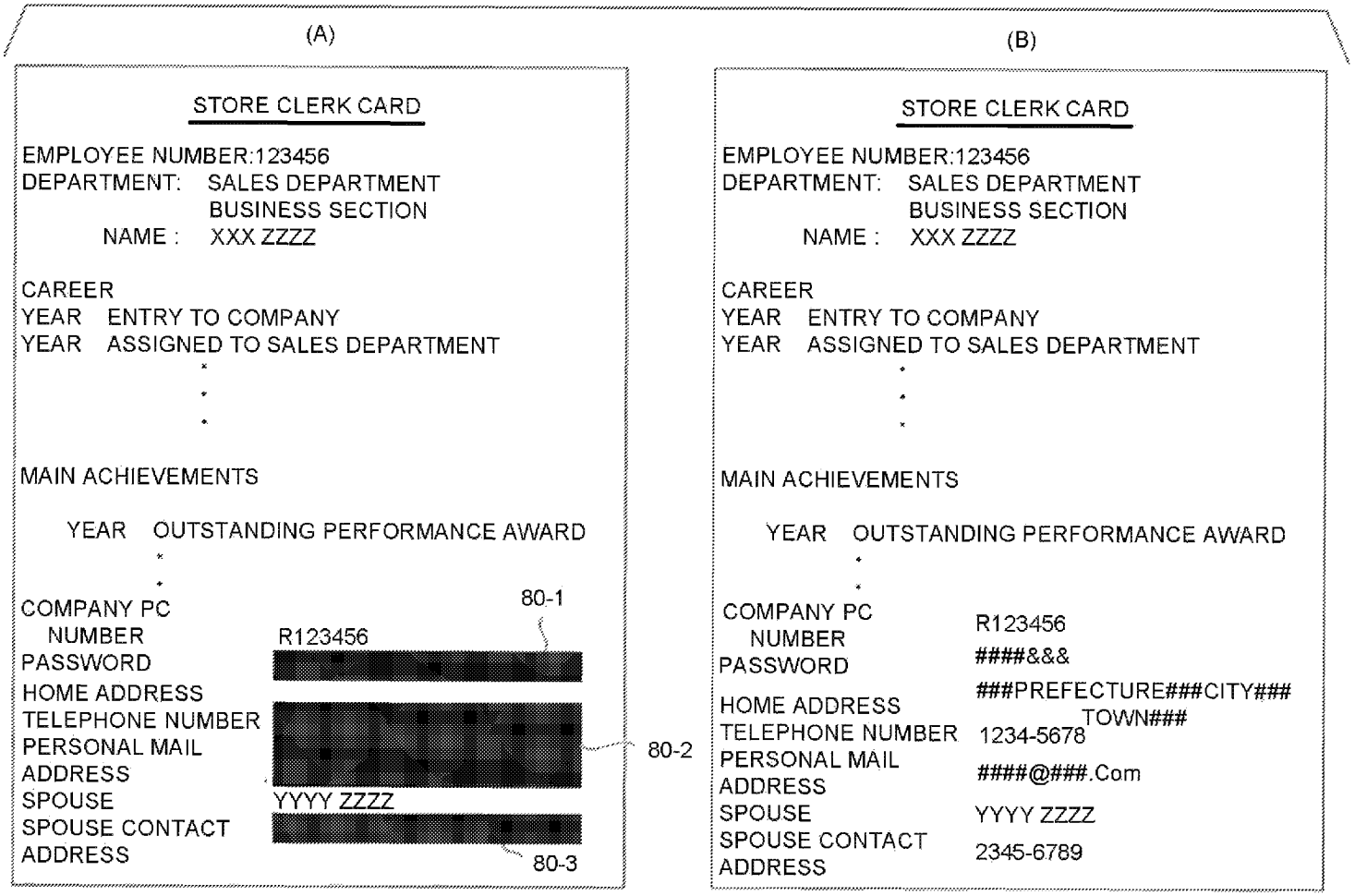
FIG. 4 is a view illustrating an example of attaching a mask to an employee card (A), and an example of erasing the mask from the employee card (B)

Herein, the mask formed on the sheet is described. FIG. 4 is a view illustrating an example (A) of a mask included on an employee card used in an enterprise and an example (B) of erasing the mask from the employee card. Information that is not desired to be known to others is included in the employee card. In this example, for example, the information includes a password, a home address, a telephone number, a personal e-mail address and a spouse contact address. In the example shown in FIG. 4(A), masks 80-1, 80-2 and 80-3 are formed on the sheet in order to hide the information. Character information of the employee card is formed on the sheet with the non-decolorable toner. Thus, the character information cannot be erased. On the other hand, the masks 80-1, 80-2 and 80-3 are formed with the decolorable toner. Thus, in a case in which the information hided by the mask is requested, it is possible to refer to the hided information by decoloring the decolorable toner (FIG. 4(B)). Then, it is possible to hide the information again by forming the mask on the sheet again.

FIG. 5 is a view illustrating an example (A) a mask included on a customer card used in a store and an example (B) of erasing the mask from the customer card. The customer card also includes information that is not desired to be known to others like the employee card. In this example, the information includes an address, date of birth, a telephone number, and an e-mail address. In the example shown in FIG. 5(A), a mask 80-4 is formed on the sheet in order to hide the information. Thus, in a case of referring to the information hided by the mask, it is possible to refer to the hidden information by decoloring the mask formed with the decolorable toner.

Figure 6:
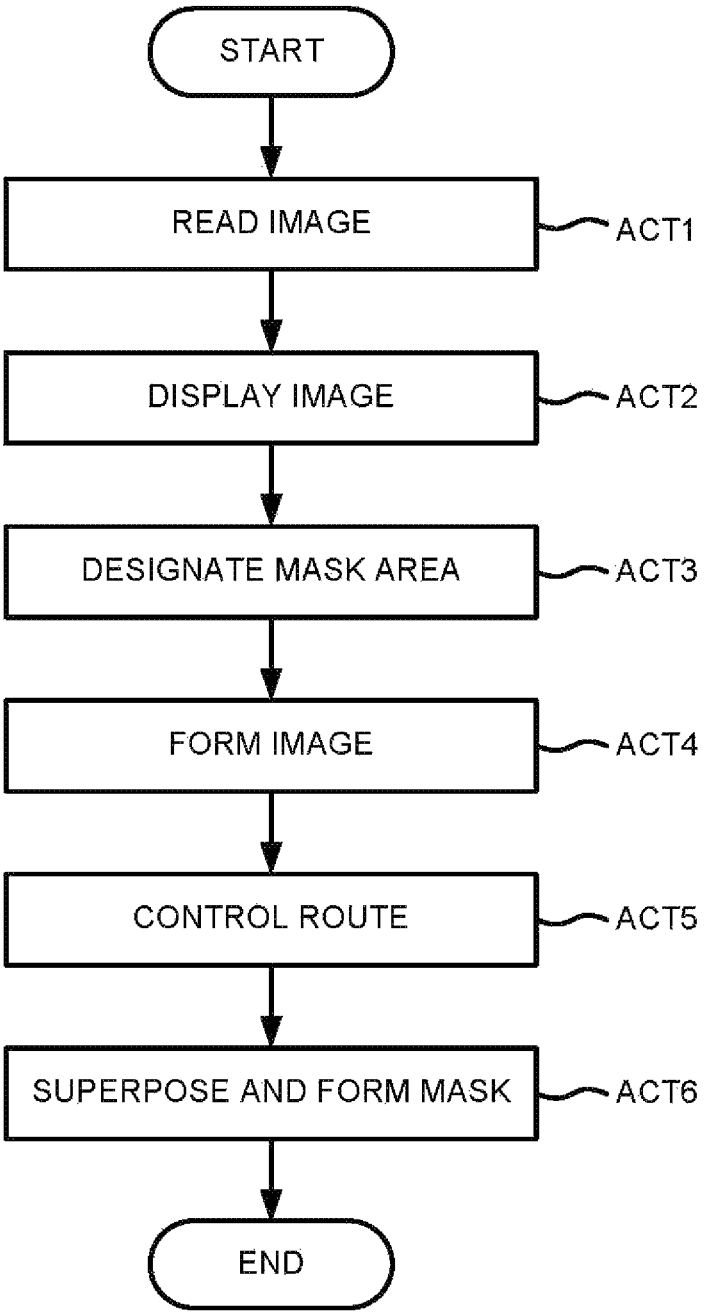
FIG. 6 is a flowchart of an example sequence of operations for forming an image and a mask on a new sheet.

Next, with reference to FIG. 6, the operations of the control system shown in FIG. 3 are described. First, the operations for forming an image and a mask on a new sheet are described. FIG. 6 is a flowchart illustrating the operations for forming an image and a mask on a new sheet. Herein, an example of a case in which the image formed on the sheet is the employee card is described. A user operates the control panel 120 to select a security mode. If the security mode is selected, the mask control unit 62 gives an instruction to place a sheet with an original image in the image reading unit 200 on the display 110. The user, for example, places the sheet with the original image shown in FIG. 4(B) on the image reading unit 200, and carries out an operation for starting execution on the control panel 120.

The image reading unit 200 reads the original image, and temporarily stores the information of the read original image therein (ACT 1). The control unit 60 displays the image on the display 110 (ACT 2). The control unit 60 controls the display 110 to display an instruction to carry out the operation of designation of a mask area. The user observes the image displayed on the display 110, and operates the control panel 120 to carry out the designation of the mask area (ACT 3). For example, the masks 80-1, 80-2 and 80-3 shown in FIG. 4(A) are designated. The mask control unit 62 specifies a coordinate value of the designated mask area based on the operation of the user.

Next, the image forming unit 20 forms the image generated in the image reading unit 200 on the sheet supplied from the sheet housing unit 140 with the non-decolorable toner (ACT 4). Then, the conveyance control unit 63 controls the conveyance control device 42 so that the sheet after the image formation is carried out is conveyed on the conveyance path 41 shown in FIG. 2 after passing through a fixing unit 30 (ACT 5). Subsequently, the image forming unit 20 superposes and forms the mask on the sheet after the image formation is carried out on the basis of the coordinate value of the mask area with the decolorable toner (ACT 6). Then, the conveyance control unit 63 controls the conveyance control device 42 so that the sheet having the mask form thereon is conveyed on the conveyance path 43 shown in FIG. 2, and discharges the sheet having the mask formed thereon is carried out to the tray 150. Through the operations, the employee card shown in FIG. 4(A) is discharged to the tray 150.

Next, the operations for decoloring the mask formed on are described. First, the user puts the sheet on which the mask is formed into the sheet housing unit 140. At this time, the sheet may be placed manually. The user operates the control panel 120 to select a mask erasing mode. When the mask erasing mode is selected, the mask control unit 62 conveys the sheet on which the mask is formed from the sheet housing unit 140 to the fixing unit 30. Then, the mask part on the sheet is erased by the fixing unit which is heated to 130 degrees centigrade. The sheet on which the mask is erased is conveyed on the conveyance path 43 shown in FIG. 2 and discharged to the tray 150. Through the operations, the employee card shown in FIG. 4(B) is discharged to the tray 150.

The designation of the mask area may be carried out in such a manner that the user carries out marking in advance in addition to being carried out on the display. In other words, an area to be masked may be painted out with a high-lighter on the sheet placed in the image reading unit 200, and the painted-out area is read by the image reading unit 200. Then, the painted-out area is set as the mask area. In this manner, the designation of the mask area can be easily carried out.

Figure 7:
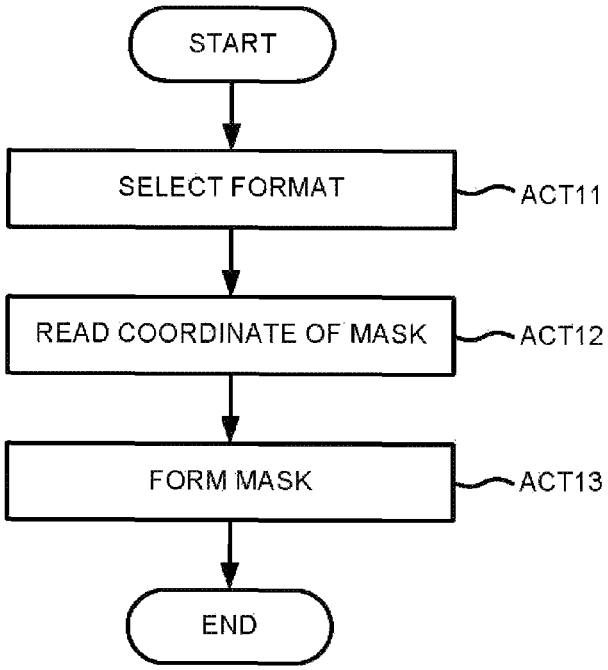
FIG. 7 is a flowchart of an example sequence of operations for forming a mask in a case in which a format is fixed.

Next, operations for forming a mask on a sheet on which a mask is formed in a case in which a format is fixed like the employee card shown in FIG. 4 are described. FIG. 7 is a flowchart illustrating the mask forming operation in a case in which the format is fixed. Herein, a case in which the format of the sheet on which the mask is formed is the employee card is described. First, the user operates the control panel 120 to select the security mode for a case in which the format is fixed. The user selects a format of the sheet on which the mask is formed from the formats displayed on the display 110 (ACT 11). Herein, the "employee card" is selected. The user puts the sheet on which the image of the employee card is formed into the sheet housing unit 140. At this time, the sheet may be placed manually. Then, the user carries out the operation for starting the execution on the control panel 120.

Next, the mask control unit 62 reads coordinate information of the mask for the selected format from the mask information storage unit 70 (ACT 12). The coordinate information of the information which is supposed to be masked is stored in the mask information storage unit 70 for each format in advance. For example, in the case of the employee card shown in FIG. 4, the coordinate information of the masks 80-1, 80-2 and 80-3 are stored in advance. In the case of the customer card shown in FIG. 5, the coordinate information of the mask 80-4 is stored in advance.

Next, the image forming unit 20 superposes and forms the mask on the sheet of the employee card with the decolorable toner on the basis of the coordinate information of the mask area (ACT 13).

In this manner, the coordinate information of the mask corresponding to the format is stored in advance, and the designation of the mask area is possible by simply selecting the format, and thus it is possible to omit the job of the designation of the mask area.

Figure 8:
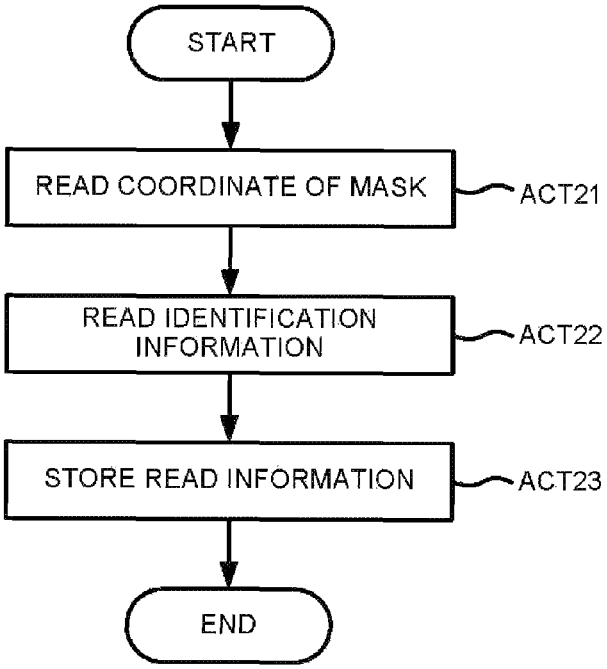
FIG. 8 is a flowchart of an example sequence of operations for storing mask information.
Figure 9:
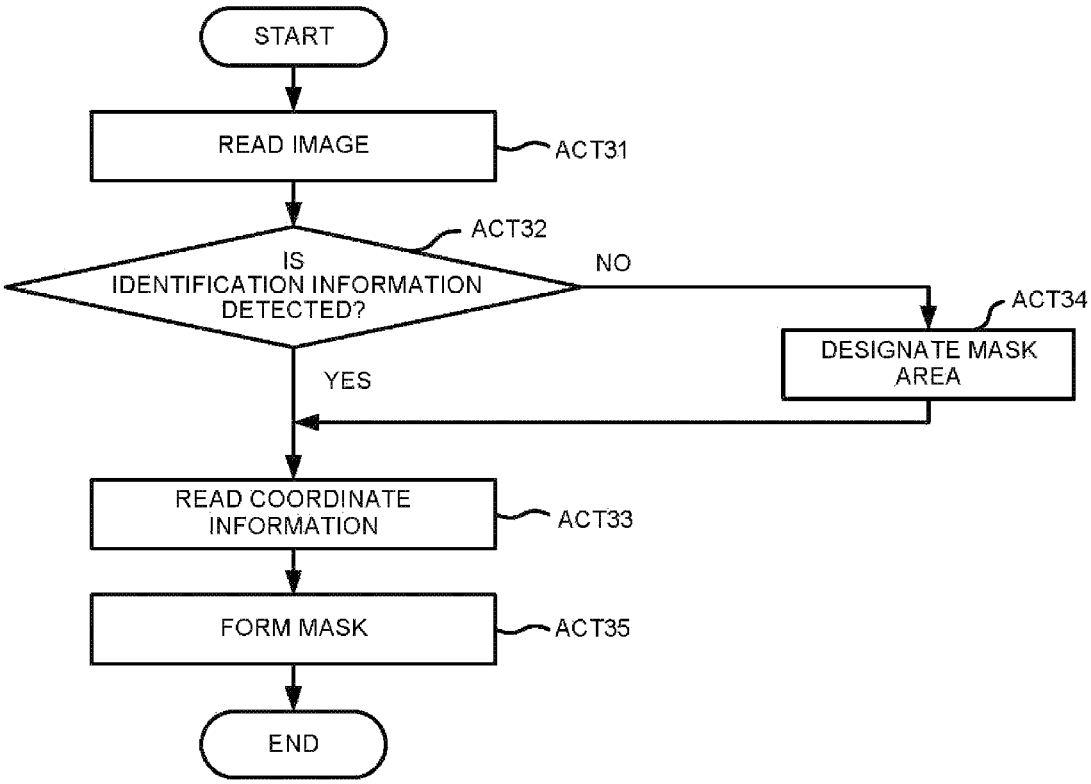
FIG. 9 is a flowchart of an example sequence of operations for forming a mask.

Next, at the time of the decoloring of the mask, the operations for storing the mask information before the decoloring of the mask is carried out in advance and forming the mask again on the basis of the stored mask information are described. FIG. 8 and FIG. 9 are flowcharts illustrating the operations for forming the mask again on the basis of the stored mask information. First, with reference to FIG. 8, the operations for storing the mask information in advance are described. Through the foregoing operations, at the time of the decoloring of the mask, the coordinate information of the mask to be decolored is read by the scanner 50 before the sheet arrives at the secondary transfer unit 24 from the sheet housing unit 140 (ACT 21). Further, the scanner 50 reads identification information for identifying the conveyed sheet (ACT 22). The identification information described herein refers to an employee number in the case of the employee card shown in FIG. 4. The identification information refers to a customer number in the case of the customer card shown in FIG. 5. In other words, information which can uniquely identify the sheet on which the mask is decolored is generally the identification information.

Next, the mask control unit 62 stores the coordinate information of the mask read by the scanner 50 and the identification information of the sheet in the mask information storage unit 70 in an associated manner (ACT 23).

Through the operations, the setting of the same mask can be easily carried out again by storing the coordinate information of the mask and the identification information of the sheet in advance in an associated manner before decoloring the mask.

Next, with reference to FIG. 9, the operations for forming the mask again by using the identification information of the sheet are described. First, the user inputs the sheet into the sheet housing unit 140 at the time of forming the mask again. Then, the user selects the security mode. The scanner 50 reads the image of the sheet before the sheet arrives at the secondary transfer unit 24 from the sheet housing unit 140 (ACT 31). Then, the mask control unit 62 determines whether or not the identification information for identifying the sheet is detected in the image read by the scanner 50 (ACT 32). If the identification information is detected (YES in ACT 32), the mask control unit 62 reads the coordinate information of the mask associated with the identification information from the mask information storage unit 70 (ACT 33). Then, the mask control unit 62 forms the mask on the sheet by using the coordinate information of the mask (ACT 35).

On the other hand, if the identification information is not detected (No in ACT 32), the mask control unit 62 displays the image read by the scanner 50 on the display 110. Then, the mask control unit 62 carries out the designation of the mask area similarly with the foregoing operation and carries out the formation of the mask on the basis of the designated mask area (ACT 35).

In this manner, in a case in which the identification information is detected, as the stored mask information is used, the designation of the mask information can be easily carried out.

Figure 10:
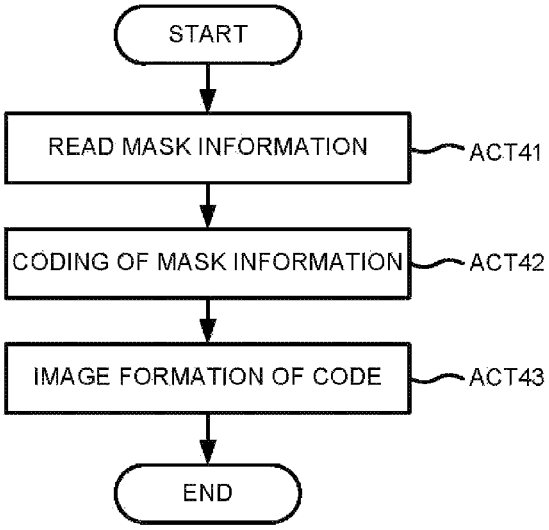
FIG. 10 is a flowchart of an example sequence of operations for forming coded mask information.
Figure 11:
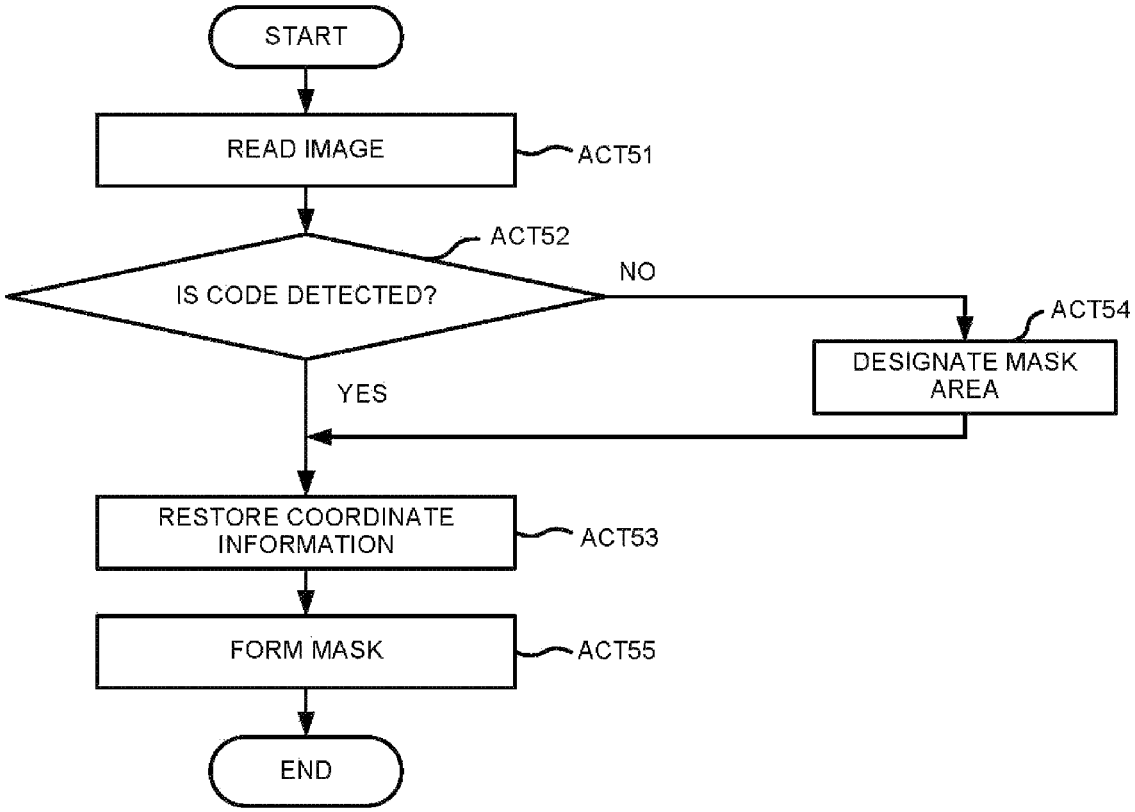
FIG. 11 is a flowchart of another example sequence of operations for forming a mask.

Next, at the time of the decoloring of the mask, the operations for coding the mask information before the decoloring of the mask is carried out and carrying out forming the mask again on the basis of the coded mask information are described. FIG. 10 and FIG. 11 are flowcharts illustrating the operations for forming the mask using coded mask information. First, with reference to FIG. 10, the operations for coding the mask information and forming the image on the sheet are described. Through the foregoing operation, at the time of the decoloring of the mask, the coordinate information of the mask to be decolored is read by the scanner 50 before the sheet arrives at the secondary transfer unit 24 from the sheet housing unit 140 (ACT 41).

Next, the mask control unit 62 codes the coordinate information of the mask read by the scanner 50 with a two-dimensional code (data matrix code) (ACT 42). Then, the image forming control unit 61 controls the image forming unit 20 to carry out the image formation on the two-dimensional code at any one corner of four corners of the sheet using the non-decolorable toner (ACT 43). After the two-dimensional code is fixed by the fixing unit 30, the sheet is conveyed on the conveyance path 41 by the conveyance control device 42, and the decoloring of the mask is carried out at a point of time at which the sheet arrives at the fixing unit 30 again.

Through the operations, the setting of the same mask can be easily carried out again by coding the coordinate information of the mask and carrying out the image formation including the code before decoloring the mask.

Next, with reference to FIG. 11, operations for carrying out the setting of the mask again by using the two-dimensional code on the sheet are described. First, the user puts the sheet into the sheet housing unit 140 at the time of carrying out the setting of the mask again. Then, the user selects the security mode. The scanner 50 reads the image of the sheet before the sheet arrives at the secondary transfer unit 24 from the sheet housing unit 140 (ACT 51). The mask control unit 62 determines whether or not the two-dimensional code is detected in the image read by the scanner 50 (ACT 52). If the two-dimensional code is detected (YES in ACT 52), the mask control unit 62 determines the coordinate information of the mask from the two-dimensional code (ACT 53). Then, the mask control unit 62 forms the mask on the sheet by using the determined coordinate information of the mask (ACT 55).

On the other hand, if the two-dimensional code is not detected (No in ACT 52), the mask control unit 62 displays the image read by the scanner 50 on the display 110. Then, the mask control unit 62 carries out the designation of the mask area similarly with the foregoing operation and carries out the formation of the mask on the basis of the designation (ACT 55).

In this manner, if the two-dimensional code is detected, as the coordinate information of the mask is determined from the two-dimensional code, the designation of the mask information can be easily carried out.

The two-dimensional code formed on the sheet may be a one-dimensional code (barcode). Further, other coding methods may be used. In other words, the coding method is not limited as long as the coordinate information of the mask can be determined from the code through the image reading.

As stated above, on the sheet having personal information that is desired to be kept secret, the mask can be formed with the decolorable toner to hide the personal information. In a case of wanting to confirm or review the information which is hid by the mask, as the mask is formed with the decolorable toner, only the mask can be decolored. Furthermore, on the decolored sheet, in a case of forming the mask again, as the mask is formed on the basis of the information of the non-decolored mask, formation of the mask can be easily carried out.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a decolorable image forming unit configured to form a decolorable image with a decolorable material; and a mask control unit configured to control the decolorable image forming unit to form, with the decolorable material on a sheet, a mask that hides at least one portion of an image formed on the sheet with non-decolorable material.

2. The image forming apparatus according to claim 1, further comprising:

a non-decolorable image forming unit configured to form a non-decolorable image with a non-decolorable material;

an image forming control unit configured to control the non-decolorable image forming unit to form the non-decolorable image on the sheet based on the generated image information.

3. The image forming apparatus according to claim 2, further comprising:

a mask information storage unit that stores coordinate information of a masked area for each of a plurality of document formats, wherein the mask control unit is further configured to receive a selection of one of the plurality of document formats, and the mask control unit controls the non-decolorable image forming unit to form the mask on the sheet based on the coordinate information corresponding to the selected document format.

4. The image forming apparatus according to claim 2, further comprising:

an image reading unit configured to generate image information by reading a document, wherein the mask control unit is further configured to identify a designation of at least one portion of the generated image, and the at least one portion of image formed on the sheet on which the non-decolorable image forming unit forms the mask corresponds to the designated at least one portion of the generated image.

5. The image forming apparatus according to claim 2, further comprising:

an image reading unit configured to generate image information by reading a document; and a display unit configured to display the generated image, wherein the mask control unit is further configured to receive a designation of at least one portion of the generated image displayed on the display, and the at least one portion of image formed on the sheet on which the non-decolorable image forming unit forms the mask corresponds to the designated at least one portion of the generated image.

6. The image forming apparatus according to claim 2, wherein the mask control unit is further configured to control a decoloring process on the sheet to decolor the mask.

7. The image forming apparatus according to claim 6, further comprising:

an image reading unit configured to generate image information by reading the sheet, wherein the mask control unit is configured to, based on image information generated by reading the sheet before the sheet is subject to the decoloring processing, determine coordinate information of the mask formed on the sheet and identification information of the sheet; and a mask information storage unit that stores the coordinate information of the mask in correspondence with the identification information of the sheet, wherein when the sheet having identification information is detected, the mask control unit controls the decolorable image forming unit to re-form the mask on the sheet based on the coordinate information of the mask stored in the mask information storage unit in correspondence with the identification information.

8. The image forming apparatus according to claim 2, further comprising:

an image reading unit configured to generate image information by reading the sheet, wherein:

the image forming control unit is further configured to control the non-decolorable image forming unit to form on the sheet a code indicating coordinate information of the mask, the mask control unit is further configured to determine, based on the code included in the image information generated, the coordinate information of the mask formed on the sheet, and the mask control unit controls the decolorable image forming unit to re-form the mask on the sheet based on the coordinate information of the mask determined based on the code.

9. The image forming apparatus according to claim 2, further comprising:

an image reading unit configured to generate image information by reading a document; and a display unit configured to display the generated image, wherein the controller is further configured to receive a designation of at least one portion of the generated image displayed on the display, and the at least one portion of image formed on the sheet on which the non-decolorable image forming unit forms the mask corresponds to the designated at least one portion of the generated image.

10. A method of forming a mask on a sheet comprising the steps of:

providing a sheet having a non-decolorable image formed thereon;

determining at least one portion on the non-decolorable image to be masked; and forming a mask with a decolorable material on the determined at least one portion to hide image contents of the at least one portion.

11. The method according to claim 10, further comprising the steps of:

generating image information by reading a document;

forming the non-decolorable image on the sheet with a non-decolorable material based on the generated image information; and identifying a designation of at least one portion of the generated image, wherein the at least one portion of image formed on the sheet on which the mask is formed corresponds to the designated at least one portion of the generated image.

12. The method according to claim 10, further comprising the steps of:

storing coordinate information of a masked area for each of a plurality of document formats; and receiving a selection of one of the plurality of document formats, wherein the at least one portion on the non-decolorable image to be masked is determined based on the coordinate information corresponding to the selected document format.

13. The method according to claim 10, further comprising the steps of:

generating image information by reading a document;

displaying the generated image on a display; and receiving a designation of at least one portion of the generated image displayed on the display, wherein the at least one portion on the non-decolorable image to be masked corresponds to the designated at least one portion of the generated image.

14. The method according to claim 10, further comprising the step of:

performing a decoloring process on the sheet to decolor the mask.

15. The method according to claim 14, further comprising:

generating image information by reading the sheet before the sheet is subject to the decoloring processing;

determining, based on image information generated by reading the sheet, coordinate information of the mask formed on the sheet and identification information of the sheet;

storing the coordinate information of the mask in correspondence with the identification information of the sheet; and after the sheet is subject to the decoloring processing, re-forming the mask on the sheet based on the coordinate information of the mask stored in correspondence with the identification information.

16. The image forming apparatus according to claim 14, further comprising the steps of:

forming on the sheet, with non-decolorable material, a code indicating coordinate information of the mask;

generating image information by reading the sheet;

determining, based on the code included in the image information generated by reading the sheet, the coordinate information of the mask formed on the sheet; and after the sheet is subject to the decoloring processing, re-forming the mask on the sheet based on the determined coordinate information.

17. An image forming apparatus, comprising:

a decolorable image forming unit configured to form a decolorable image with a decolorable material;

a non-decolorable image forming unit configured to form a non-decolorable image with a non-decolorable material; and a controller configured to:

control the non-decolorable image forming unit to form the non-decolorable image on the sheet based on received image information, and control the decolorable image forming unit to form, with the decolorable material, a mask that hides at least one portion of the non-decolorable image.

18. The image forming apparatus according to claim 17, wherein:

the controller is further configured to control a storage unit that stores coordinate information of a masked area for each of a plurality of document formats, and receive a selection of one of the plurality of document formats, wherein the controller controls the non-decolorable image forming unit to form the mask on the sheet based on the coordinate information corresponding to the selected document format.

19. The image forming apparatus according to claim 17, wherein the controller is further configured to control a decoloring process on the sheet to decolor the mask.

20. The image forming apparatus according to claim 19, further comprising:

an image reading unit configured to generate image information by reading the sheet, wherein the controller is further configured to control the non-decolorable image forming unit to form on the sheet a code indicating coordinate information of the mask, determine, based on the code included in the image information generated, the coordinate information of the mask formed on the sheet, and control the decolorable image forming unit to re-form the mask on the sheet based on the coordinate information of the mask determined based on the code.

* * * * *